US007000807B2

(12) United States Patent
Cellini et al.

(10) Patent No.: US 7,000,807 B2
(45) Date of Patent: Feb. 21, 2006

(54) BATON

(75) Inventors: Vito Cellini, San Antonio, TX (US); Richard W. Martin, San Antonio, TX (US)

(73) Assignee: Lightstick Partners, LLC, San Antonio, TX (US)

( * ) Notice: Subject to any disclaimer, the term of this patent is extended or adjusted under 35 U.S.C. 154(b) by 0 days.

(21) Appl. No.: 10/847,968

(22) Filed: May 18, 2004

(65) Prior Publication Data

US 2005/0279769 A1 Dec. 22, 2005

Related U.S. Application Data

(63) Continuation of application No. 09/970,095, filed on Oct. 3, 2001, now Pat. No. 6,786,368, which is a continuation-in-part of application No. 09/850,308, filed on May 7, 2001, now abandoned.

(51) Int. Cl.
*B65D 83/00* (2006.01)

(52) U.S. Cl. ..... 222/402.11; 222/175; 222/372

(58) Field of Classification Search ..... 222/113, 222/192, 402.11, 175, 325, 372
See application file for complete search history.

(56) References Cited

U.S. PATENT DOCUMENTS

| | | | | |
|---|---|---|---|---|
| 4,247,844 | A * | 1/1981 | Zapolski et al. | 340/321 |
| 5,405,134 | A * | 4/1995 | Wolfram | 463/47.4 |
| 5,420,766 | A * | 5/1995 | Hollis | 362/96 |
| 5,673,819 | A * | 10/1997 | Brunswig | 222/113 |
| 5,795,054 | A * | 8/1998 | Booty, Jr. | 362/96 |
| 6,386,726 | B1 * | 5/2002 | Macierowski et al. | 362/102 |

* cited by examiner

*Primary Examiner*—Gene Mancene
*Assistant Examiner*—Melvin A Cartagena
(74) *Attorney, Agent, or Firm*—Christopher L. Makay

(57) ABSTRACT

A baton suitable for use in self-defense includes a body adapted to receive a canister of spray therein, a nozzle securable to the body and adapted to receive spray therethrough, and a trigger mounted on the body. The trigger mounts on the body in a location that permits grasping of the body underhanded with the thumb positioned over the trigger to permit movement of the trigger from an unfired position to a fired position that facilitates ejection of spray from the canister through the nozzle. The trigger includes an actuator and a lock coupled therewith. One motion performed with the thumb releases the lock and moves the actuator from the unfired position of the trigger to the fired position of the trigger.

21 Claims, 9 Drawing Sheets

150
153
168
166
144
146
142
140
143
147
152
162

170
154
153
166
167
168
169
155
158
157
156
151
145
146
159

136
150
135
144
143
140
142
148
141
147
149
163
152
165
162
161
164
154
170
153
166
151
168
140
144
142
143
152
141
162

150

BATON

CROSS-REFERENCES TO RELATED APPLICATION

This application is a continuation of application Ser. No. 09/970,095 filed Oct. 03, 2001, now U.S. Pat. No. 6,786, 368, which is a continuation-in-part of application Ser. No. 09/850,308, which was filed May 7, 2001, now abandoned.

BACKROUND OF THE INVENTION

1. Field of the Invention

The present invention relates to apparatus utilized in self-defense and, more particularly, but not by way of limitation, to a baton suitable for use in self-defense.

2. Description of the Related Art

Personal self-defense against criminal attack is often problematic, particularly for women, as physical size and strength are important factors because cowardly criminals prey on those weaker than themselves. Further, criminals often resort to the use of weapons, which makes a criminal attack deadly serious.

To counterbalance size and strength considerations as well as an armed criminal, law-abiding citizens often also arm themselves to fend off criminal attacks. A gun presents a most effective weapon to thwart a criminal attack because it permits a physically weaker victim to defend against a stronger or even armed assailant. Although very effective, carrying a gun presents several problems. First, many states in the United States and many countries prohibit the carrying of guns by their law-abiding citizens. Thus, an armed citizen merely seeking to defend herself becomes a criminal. Second, a gun turns any encounter into a potentially lethal one for the intended victim as well as the criminal.

Many law-abiding citizens therefore seek non-lethal methods to defend themselves against criminal attack. A popular non-lethal method involves ejecting an incapacitating spray, such as pepper spray, mace, and the like, onto a criminal assailant and, in particular, into the face and eyes of such an assailant. Various devices currently exist that eject incapacitating spray; unfortunately, such devices are often difficult to operate in that they include complicated safeties and are aimed in a manner that places the device near the user's face, which results in the potential spraying of the user as well as the criminal assailant. Accordingly, an apparatus adapted to eject an incapacitating spray that is both simple to operate and aim is highly desirable.

SUMMARY OF THE INVENTION

A baton suitable for use in self-defense includes a body adapted to receive a canister of spray therein, a nozzle securable to the body and adapted to receive spray therethrough, and a trigger mounted on the body. The body includes an aperture, and the rear end of the body may be adapted to receive attachments thereon. The trigger mounts on the body in a location that permits grasping of the body underhanded with the thumb positioned over the trigger to permit movement of the trigger from an unfired position to a fired position that facilitates ejection of spray from the canister through the nozzle.

The trigger may include an actuator and a lock coupled with the actuator. One motion performed with the thumb releases the lock and moves the actuator from the unfired position of the trigger to the fired position of the trigger. The actuator, which includes an aperture, mounts on the body and extends therein via the aperture of the body. The actuator may include a securing surface that engages the body to maintain the actuator mounted to the body. The lock is disposed through the aperture of the actuator and is engaged with the actuator. The release of the lock from the actuator permits movement of the actuator from the unfired position to the fired position. The lock includes a locking member disposed through the aperture of the body and a biasing mechanism that biases the locking member against the actuator.

The nozzle includes a passageway therethrough and a cavity communicating with the passageway, whereby the cavity receives therein a delivery tube of the canister of spray. The nozzle may include knurls or protrusions on its outer surface.

The baton may include a cap adapted to receive attachments thereon secured to a rear end of the body to maintain the trigger in the aperture of the body. The baton may also include a lock movable from a safe position that blocks the trigger to a fire position that unblocks the trigger. The lock mounts on the body and includes a lip having a notch therein and a tab that protrudes into a notch in the body. Movement of the tab to a first position within the notch of the body locates the lip in the front portion of the trigger thereby blocking the trigger, while movement of the tab to a second position within the notch of the body locates the notch of the lip in the front portion of the trigger thereby unblocking the trigger.

In a method of self-defense, a baton is grasped underhanded with the thumb positioned over a trigger, and the trigger is moved with the thumb from an unfired position to a fired position that facilitates ejection of spray from a canister disposed in the baton. Further, a lock engaged with the trigger is released in one motion and with the thumb when the trigger is moved from the unfired to the fired position. Alternatively, a lock is moved from a safe position that blocks the trigger to a fire position that unblocks the trigger.

It is therefore an object of the present invention to provide a baton suitable for self-defense that allows the securing of various attachments thereto.

It is another object of the present invention to provide a baton suitable for self-defense that may be grasped underhanded with the thumb positioned over a trigger.

It is still another object of the present invention to provide a baton suitable for self-defense that permits the release of a lock and actuation of a trigger in one simple motion.

It is yet another object of the present invention to provide a baton suitable for self-defense that permits ejection of incapacitating spray with the baton held extended at full arms length.

It is a further object of the present invention to provide a baton suitable for self-defense that permits the ejection of incapacitating spray at an upward angle.

It is still a further object of the present invention to provide a baton suitable for self-defense that functions as an effective blunt instrument for thrusting into the body of an assailant, thereby rendering the assailant incapacitated.

Still other objects, features, and advantages of the present invention will become evident to those of ordinary skill in the art in light of the following detailed description.

DETAILED DESCRIPTION OF THE PREFERRED EMBODIMENTS

Figure 1:
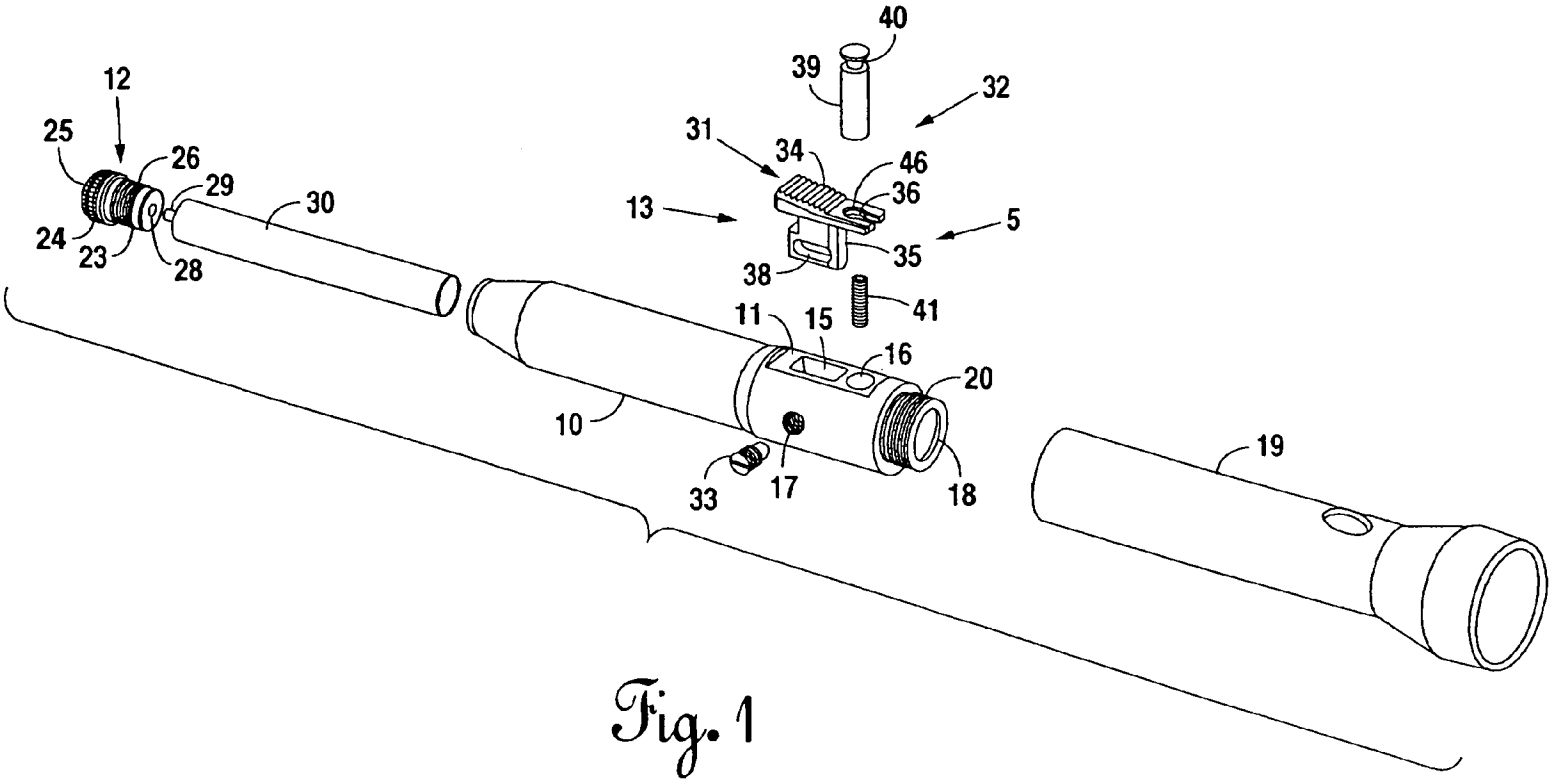
FIG. 1 is an exploded perspective view illustrating a first embodiment of a baton including an incapacitating spray canister for insertion therein and a flashlight as an attachment.
Figure 2:
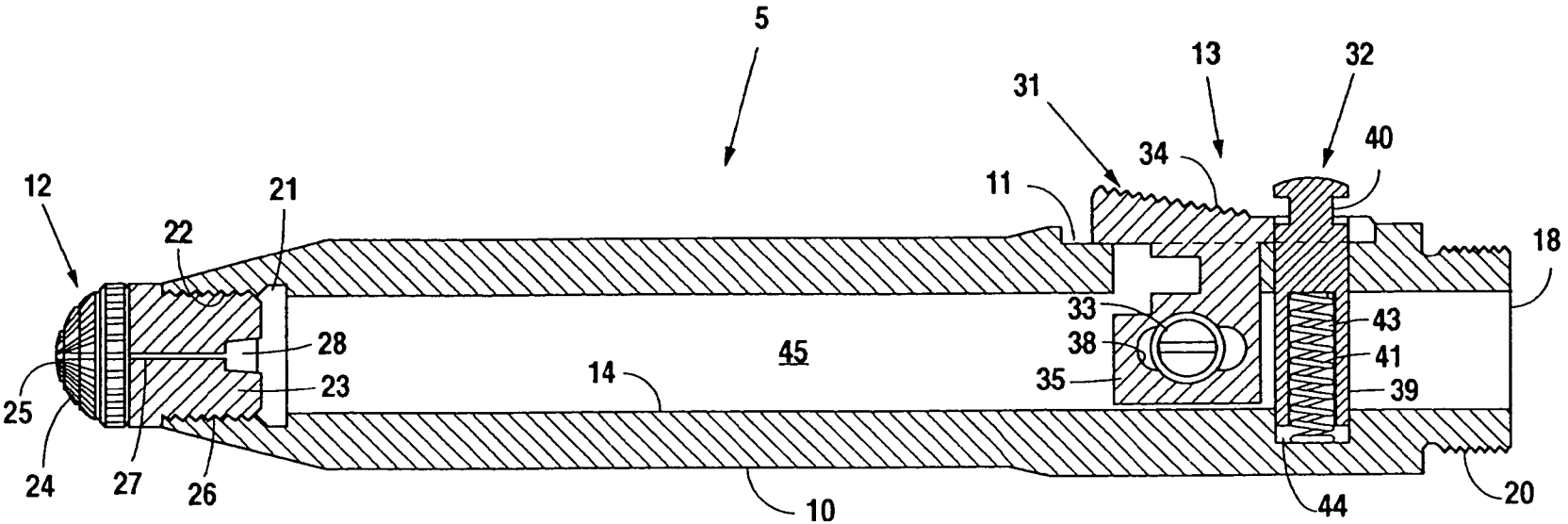
FIG. 2 is a side elevation view in cross-section illustrating the baton according to the first embodiment.
Figure 3:
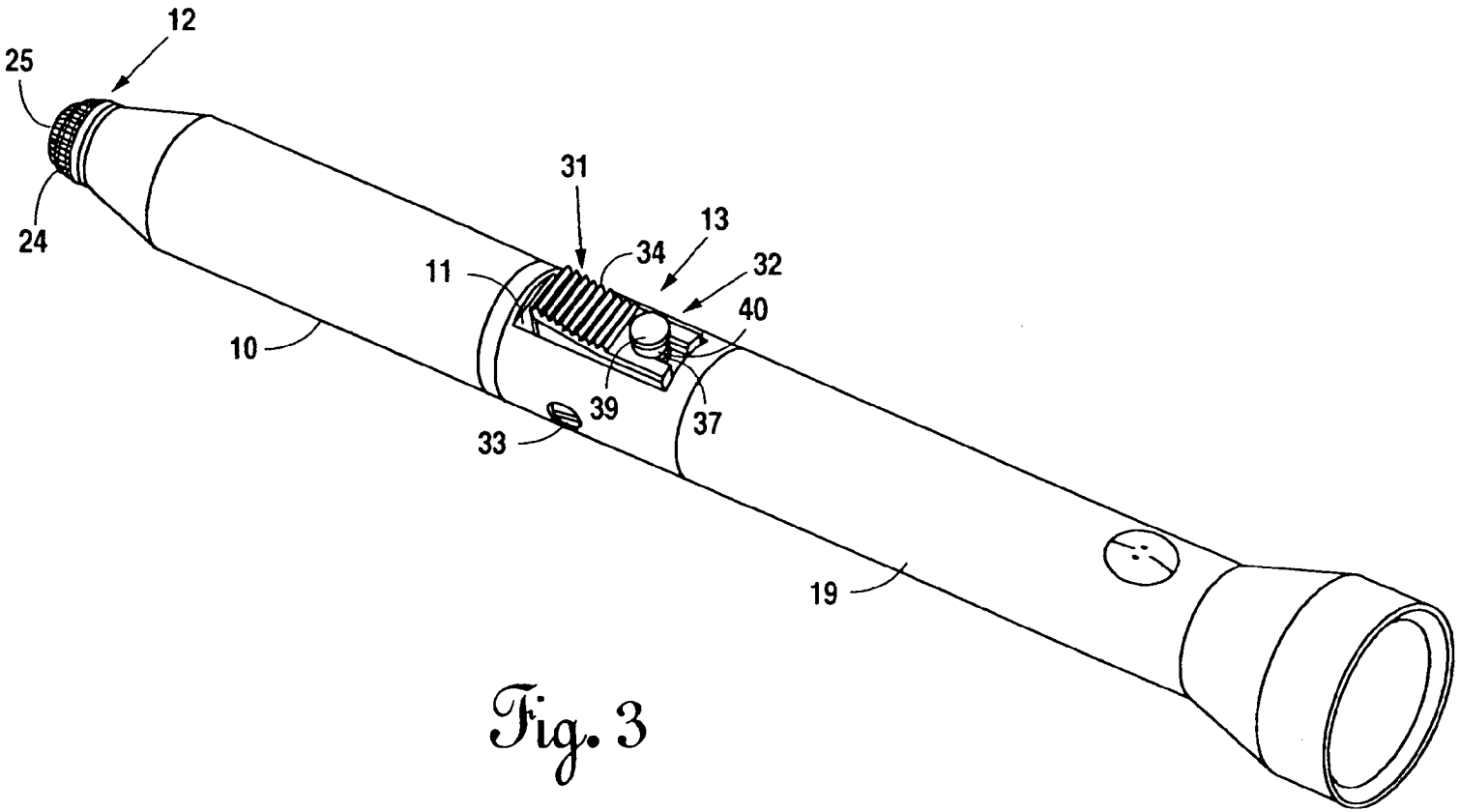
FIG. 3 is a perspective view illustrating the baton according to the first embodiment including a flashlight as an attachment.

As illustrated in FIGS. 1–3, a baton 5 according to a first embodiment is suitable for use in self-defense and includes a body 10, a nozzle 12, and a trigger 13. The body 10 includes a bore 14 therethrough, a base 11 that receives the trigger 13 thereon, and apertures 15–17 that communicate with the bore 14 and receive the trigger 13 therein. Although the apertures 15 and 16 are disclosed in this first embodiment as separate apertures, those of ordinary skill in the art will recognize that the apertures 15 and 16 could be consolidated into a single aperture. The rear end 18 of the body 10 is adapted to receive an attachment, such as the illustrated flashlight 19 or any suitable device including but not limited to a taser, stun gun, night stick, key chain, and the like. In this first embodiment, the rear end 18 includes threads 20 that receive the attachment thereon to secure the attachment to the baton 5. The bore 14 at a front portion 21 is adapted to receive the nozzle 12 therein. Particularly, in this first embodiment, the front portion 21 of the bore 14 includes threads 22 that receive the nozzle 12 therein to secure the nozzle 12 to the body 10.

The nozzle 12 includes a body 23 terminating in a tip 24 that, in this first embodiment includes knurls 25. The body 23 is adapted to fit within the front portion 21 of the bore 14, and the tip 23 abuts the front edge of the body 10. In this first embodiment, the body 23 of the nozzle 12 includes threads 26 that engage the threads 22 to facilitate securing of the nozzle 12 to the body 10. The nozzle 12 includes a passageway 27 therethrough that facilitates the delivery of an incapacitating spray through the nozzle 12. Further, the nozzle 12 includes a cavity 28 in communication with the passageway 27. The cavity 28 receives therein a delivery tube 29 of an incapacitating spray canister 30 to align the canister 30 with the nozzle 12 and facilitate the release of incapacitating spray into the passageway 27.

The trigger 13 is movable between a locked or unfired position and a released or fired position and includes an actuator 31, a lock 32, and a pin 33. The actuator 31 includes an activation member 34 having a ramped and knurled surface and including an aperture 36 having a detent 46 at its upper portion. The actuator 31 further includes an engaging member 35 having a slot 38 therein. The lock 32 includes a locking member 39, having a cavity 43 therein and a groove 40 thereabout. The lock 32 further includes a biasing mechanism, which in this first embodiment is a spring 41, although any suitable biasing mechanism may be used.

The spring 41 fits within the cavity 43, and the locking member 39 via the groove 40 passes through an opening 37 into the aperture 36 until the locking member 39 resides within a front portion of the aperture 36. The detent 46 of the aperture 36 engages the lower surface of the locking member 39 defining the groove 40 to maintain the locking member 39 within and abutting against the activation member 34. The locking member 39 passes through the aperture 16 and resides within the bore 14 of the body 10, and the engaging member 35 of the actuator 31 passes through the aperture 15 until the activation member 34 resides atop the base 11 of the body 10. The body 10 at the portion of bore 14 below the locking member 39 and spring 41 may include a cavity 44 that receives the spring 41 and the locking member 39 therein to secure the lock 32 within the bore 14. The aperture 17 is adapted to receive the pin 33 therein, and in this first embodiment the aperture 17 and the pin 33 include threads that engage to mount the pin 33 within the aperture 17. The pin 33 extends into the bore 14 and engages the slot 38 of the engaging member 35 to maintain the actuator 31 secured within the bore 14. The engaging member 35 resides within the bore 14 and blocks the bore 14 to define a chamber 45 that receives the canister 30 therein.

The trigger 13 begins in the locked or unfired position because the spring 41 biases the locking member 39 against the detent 46 of the aperture 36. In use, the nozzle 12 is removed from the body 10 and the canister 30 is slid into the chamber 45 until its rear end abuts the front face of the engaging member 35. The nozzle 12 is then replaced such that the delivery tube 29 of the canister 30 resides within the cavity 28 of the nozzle 12. To fire incapacitating spray from the canister 30, the body 10 is grasped underhanded with the thumb positioned over the trigger 13. From that position, the top of the locking member 39 is depressed, which disengages the locking member 39 from the detent 46 due to the compression of the spring 41. In the same motion that depresses the locking member 39, the actuator 31 is moved forward until the locking member 39 resides within a rear portion of the aperture 36, thereby placing the trigger 13 in its released or fired position. The actuator 31 now moves forward because the groove 40 is aligned with the aperture 36. Moreover, the activating member 34 and the engaging member 35 travel forward due to the slot 38, which permits the engaging member 35 to slide along the pin 33. The forward travel of the engaging member 35 compresses the delivery tube 29 of the canister 30 against the cavity 28 of the nozzle 12 facilitating release of incapacitating spray from the canister 30. The incapacitating spray ejects from the canister 30 and delivery tube 29 and into the passageway 27 of the nozzle 12. The passageway 27 delivers the incapacitating spray from the nozzle 12 and further serves to focus the incapacitating spray onto a target.

Upon the release of the actuator 31, the delivery tube 29 decompresses from against the cavity 28 of the nozzle 12. The delivery tube 29 thus forces the canister 30 rearward, which, in turn, moves the activating member 34 and the engaging member 35 backward. Particularly, the actuator 31 moves backward until the locking member 39 resides within the front portion of the aperture 36 so that the spring 41 biases the locking member 39 against the detent 46 of the aperture 36, which again places the trigger 13 in its locked or unfired position. A biasing mechanism such as a spring may be inserted between the nozzle 12 and the canister 30 or the engaging member 35 and the canister 30 to aid in returning the trigger 13 to its locked or unfired position. Incapacitating spray is thusly ejected from the baton 5 until the canister 30 is empty, at which point, the canister 30 is removed and substituted with a filled one.

The baton 5 provides many advantages as a tool for self-defense. Illustratively, the baton 5 is versatile in that it allows the securing of various attachments thereto, such as the illustrated flashlight 19 or any suitable device including but not limited to a taser, stun gun, night stick, key chain, and the like. Further, the location of the trigger 13 permits advantageous grasping of the baton 5 for self-defense situations. The baton 5 is grasped underhanded with the thumb positioned directly over the trigger 13. From that position, the lock 32 may be released and the trigger 13 actuated in one simple motion as described above, which is extremely advantageous in self-defense situations. The underhanded grasping of the baton 5 also permits the activation of the trigger 13 to facilitate ejection of incapacitating spray with the baton 5 held extended at full arms length, which prevents incapacitating spray from accidentally landing on the face of the user. Moreover, the underhanded grasping of the baton 5 permits the ejection of incapacitating spray at an upward angle, which is a most effective angle for ensuring the incapacitating spray lands on the face of an assailant and enters the eyes, nose, and throat of the assailant. Still further, the baton 5 functions as an effective blunt instrument for thrusting into the body of an assailant, thereby rendering the assailant incapacitated.

Additionally, the nozzle 12 includes knurls 25 that facilitate the emptying of a pocket without the necessity of using one's hand, which is advantageous for law enforcement officers, as suspects often have a needle, knife, razor blade, or other sharp instruments in their pockets. Particularly, the baton 5 is thrust into a pocket and twirled so that the knurls 25 grasp the pocket. The baton 5 is then removed which reverses the pocket and empties its contents.

Figure 4A:
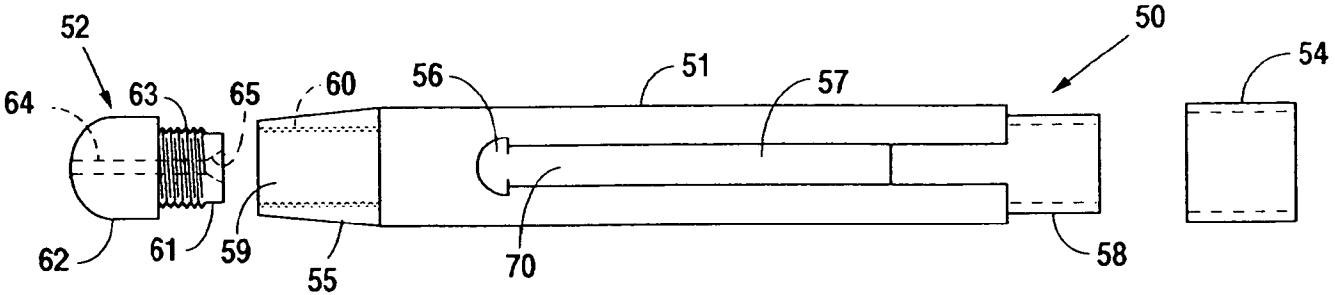
FIG. 4A is an exploded top plan view illustrating a second embodiment of a baton.
Figure 4B:
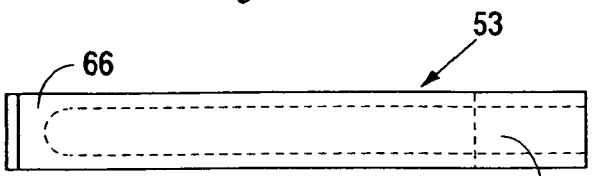
FIG. 4B is a top plan view illustrating a trigger for the baton according to the second embodiment.
Figure 4C:
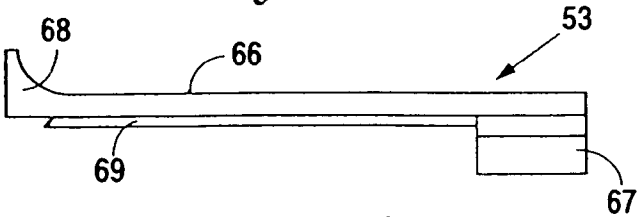
FIG. 4C is a side elevation view illustrating the trigger for the baton according to the second embodiment.

As illustrated in FIGS. 4A–4C, a baton 50 according to a second embodiment is suitable for use in self-defense and includes a body 51, a nozzle 52, a trigger 53, and a cap 54. The body 51 includes a bore 55 therethrough, a base 56 that receives the trigger 53 thereon, and an aperture 57 that communicates with the bore 55 and receives the trigger 53 therein. The underneath edge of the base 56 may include a beveled surface that provides for easier engagement of the trigger 53 with the base 56. The rear end 58 of the body 51 is adapted to receive the cap 54. In this second embodiment, the cap 54 may be press fit onto the rear end 58 or the rear end 58 and the cap 54 may include threads that engage to secure the cap 54 onto the baton 50. The cap 54 may be adapted to receive suitable devices including but not limited to a flashlight, taser, stun gun, night stick, key chain, and the like. The bore 55 at a front portion 59 is adapted to receive the nozzle 52 therein. Particularly, in this second embodiment, the front portion 59 of the bore 55 includes threads 60 that receive the nozzle 52 therein to secure the nozzle 52 to the body 51.

The nozzle 52 includes a body 61 terminating in a tip 62. The tip 62 may include knurls or protrusions. The body 61 is adapted to fit within the front portion 59 of the bore 55, and the tip 62 abuts the front edge of the body 51. In this second embodiment, the body 61 of the nozzle 52 includes threads 63 that engage the threads 60 to facilitate securing of the nozzle 52 to the body 51. The nozzle 52 includes a passageway 64 therethrough that facilitates the delivery of an incapacitating spray through the nozzle 52. Further, the nozzle 52 includes a cavity 65 in communication with the passageway 64. The cavity 65 receives therein a delivery tube of an incapacitating spray canister to align the canister with the nozzle 52 and facilitate the release of incapacitating spray into the passageway 64.

The trigger 53 is movable between an unfired position and a fired position. The trigger 53 includes an actuator member 66 and an engaging member 67. The actuator member 66 includes a ramped surface 68 and a securing surface 69 that engages the underneath edge of the base 56 to maintain the trigger 53 on the base 56. The securing surface 69 of the actuator member 66 may include a beveled surface that provides for easier engagement of the trigger 53 with the base 56. The securing surface 69 aligns with the aperture 57 and the trigger 53 slides forward until it resides completely within the aperture 57. The cap 54 secures to the rear end 58 of the body 51 in a position where the front edge of the cap 54 abuts the rear edge of the trigger 53 to maintain the trigger 53 within the aperture 57. The engaging member 67 resides within the bore 55 and blocks the bore 55 to define a chamber 70 that receives a canister of incapacitating spray therein. The trigger 53 may include a lock as in the first embodiment or any other locking mechanism suitable to prevent the accidental actuation of the trigger 53 and discharge of incapacitating spray.

In use, the nozzle 52 is removed from the body 51 and a canister of incapacitating spray is slid into the chamber 70 until its rear end abuts the front face of the engaging member 67 and the trigger 53 is moved to its unfired position. The nozzle 52 is then replaced such that a delivery tube of the canister resides within the cavity 65 of the nozzle 52. Although this second embodiment discloses the nozzle 52 as removable, the nozzle 52 may be integral with the body 51. In this instance, the cap 54 may be removed from the rear end 58, the canister may be inserted through the rear end 58, and the cap 54 resecured to rear end 58. To fire incapacitating spray from the canister, the body 51 is grasped underhanded with the thumb positioned over the trigger 53. From that position, the thumb moves the actuator member 66 forward, which places the trigger 53 in its fired position. Particularly, the actuator member 66 and the engaging member 67 travel forward due to the aperture 57 being longer than the trigger 53. The forward travel of the engaging member 67 compresses the delivery tube of the canister against the cavity 65 of the nozzle 52 facilitating release of incapacitating spray from the canister. The incapacitating spray ejects from the canister and delivery tube and into the passageway 64 of the nozzle 52. The passageway 64 delivers the incapacitating spray from the nozzle 52 and further serves to focus the incapacitating spray onto a target.

Upon the release of the actuator member 66, the delivery tube decompresses from against the cavity 65 of the nozzle 52. The delivery tube thus forces the canister rearward, which, in turn, moves the actuator member 66 and the engaging member 67 backward, thereby returning the trigger 53 to its unfired position. A biasing mechanism such as a spring may be inserted between the nozzle 52 and the canister or the engaging member 67 and the canister to aid in returning the trigger 53 to its unfired position. Incapacitating spray is thusly ejected from the baton 50 until the canister is empty, at which point, the canister is removed and substituted with a filled one.

The baton 50 provides many advantages as a tool for self-defense. Illustratively, the location of the trigger 53 permits advantageous grasping of the baton 50 for self-defense situations. The baton 50 is grasped underhanded with the thumb positioned directly over the trigger 53. From that position, the trigger 53 may be actuated in one simple motion as described above, which is extremely advantageous in self-defense situations. The underhanded grasping of the baton 50 further permits the actuation of the trigger 53 to facilitate ejection of incapacitating spray with the baton 50 held extended at full arms length, which prevents incapacitating spray from accidentally landing on the face of the user. Moreover, the underhanded grasping of the baton 50 permits the ejection of incapacitating spray at an upward angle, which is a most effective angle for ensuring the incapacitating spray lands on the face of an assailant and enters the eyes, nose, and throat of the assailant. Still further, the baton 50 functions as an effective blunt instrument for thrusting into the body of an assailant, thereby rendering the assailant incapacitated.

Figure 5:
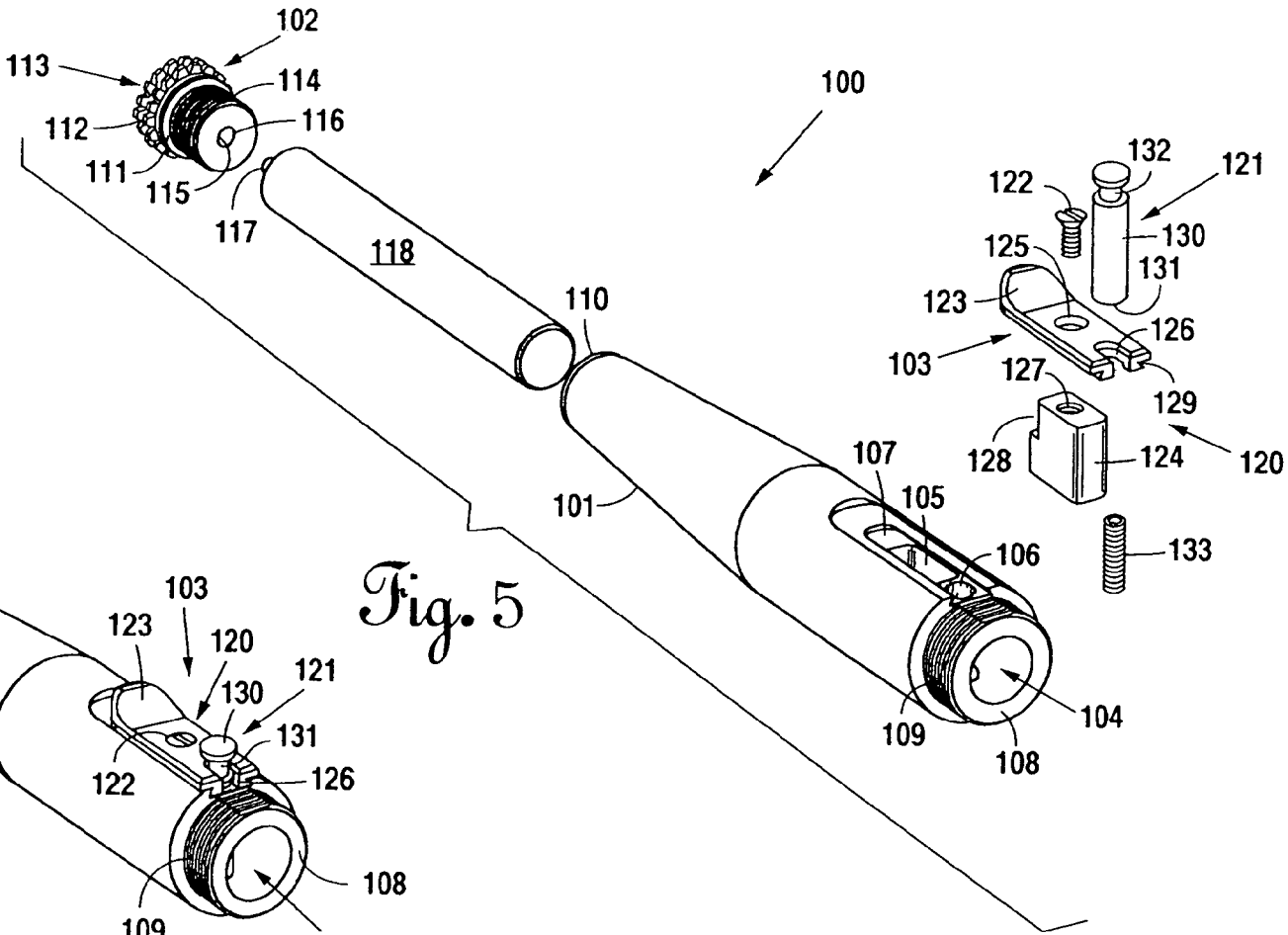
FIG. 5 is an exploded perspective view illustrating a third embodiment of a baton including an incapacitating spray canister for insertion therein and a flashlight as an attachment.
Figure 6:
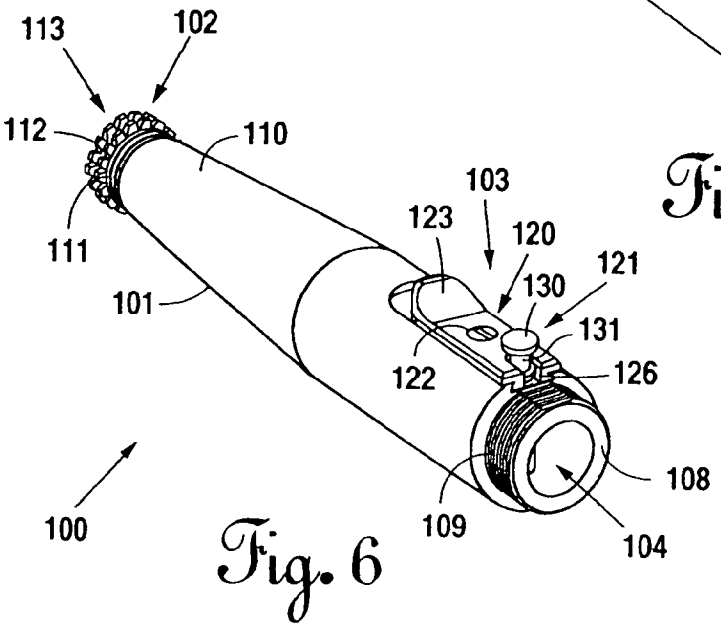
FIG. 6 is a perspective view illustrating the baton according to the third embodiment.

As illustrated in FIGS. 5 and 6, a baton 100 according to a third embodiment is suitable for use in self-defense and includes a body 101, a nozzle 102, and a trigger 103. The body 101 includes a bore 104 therethrough, a base 107 that receives the trigger 103 thereon, and apertures 105 and 106 that communicate with the bore 104 and receive the trigger 103 therein. Although the apertures 105 and 106 are disclosed in this third embodiment as separate apertures, those of ordinary skill in the art will recognize that the apertures 105 and 106 could be consolidated into a single aperture. The rear end 108 of the body 101 is adapted to receive an attachment, such as a flashlight or any suitable device including but not limited to a taser, stun gun, night stick, key chain, and the like. In this third embodiment, the rear end 108 includes threads 109 that receive the attachment thereon to secure the attachment to the baton 100. The bore 104 at a front portion 110 is adapted to receive the nozzle 102 therein. Particularly, in this third embodiment, the front portion 110 of the bore 104 includes threads that receive the nozzle 102 therein to secure the nozzle 102 to the body 101.

The nozzle 102 includes a body 111 terminating in a tip 112 that, in this third embodiment includes protrusions 113. The body 111 is adapted to fit within the front portion 110 of the bore 104, and the tip 112 abuts the front edge of the body 101. In this third embodiment, the body 111 of the nozzle 102 includes threads 114 that engage the threads in the front portion 110 of the bore 104 to facilitate the securing of the nozzle 102 to the body 101. The nozzle 102 includes a passageway 115 therethrough that facilitates the delivery of an incapacitating spray through the nozzle 102. Further, the nozzle 102 includes a cavity 116 in communication with the passageway 115. The cavity 116 receives therein a delivery tube 117 of an incapacitating spray canister 118 to align the canister 118 with the nozzle 102 and facilitate the release of incapacitating spray into the passageway 115.

The trigger 103 is movable between a locked or unfired position and a released or fired position and includes an actuator 120, a lock 121, and a securing member 122. The actuator 120 includes an activation member 123 having a ramped surface and including apertures 125 and 126 and a securing surface 129. The actuator 120 further includes an engaging member 124 having a cavity 127 and a removed portion 128. The lock 121 includes a locking member 130, having a cavity 131 therein and a groove 132 thereabout. The lock 121 further includes a biasing mechanism, which in this third embodiment is a spring 133, although any suitable biasing mechanism may be used.

The engaging member 124 of the actuator 120 passes through the aperture 105 and resides within the bore 104 to block the bore 104 and define a chamber that receives the canister 118 therein. The activation member 123 slides into the base 107, and the securing surface 129 engages an underneath edge of the base 107 to maintain the trigger 103 on the base 107. The base 107 permits the activation member 123 to slide forward to a position that exposes the aperture 106. The spring 133 fits within the cavity 131, and the locking member 130 and the spring 133 pass through the aperture 106 and reside within the bore 104 of the body 101. The body 101 at the portion of bore 104 below the locking member 130 and the spring 133 may include a cavity that receives the spring 133 and the locking member 130 therein to secure the lock 121 within the bore 104. After the mounting of the lock 121, the groove 132 is aligned with the aperture 126 of the activation member 123, and the activation member 123 is slid rearward until the locking member 130 resides within a front portion of the aperture 126. An underneath edge of the aperture 126 engages the lower surface of the locking member 130 defining the groove 132 to maintain the locking member 130 within and abutting against the activation member 123. With the locking member 130 positioned within a front portion of the aperture 126, the aperture 125 of the activation member 123 aligns with the cavity 127 of the engaging member 124. The securing member 122, which in this third embodiment is a screw, passes through the aperture 125 and engages the cavity 127, which is adapted to receive the securing member 122 therein, thereby coupling the activation member 123 to the engaging member 124.

The trigger 103 begins in the locked or unfired position because the spring 133 biases the locking member 130 against the activation member 123. In use, the nozzle 102 is removed from the body 101 and the canister 118 is slid into the chamber defined by the bore 104 and the engaging member 124 until its rear end abuts the front face of the engaging member 124. The nozzle 102 is then replaced such that the delivery tube 117 of the canister 118 resides within the cavity 116 of the nozzle 102. To fire incapacitating spray from the canister 118, the body 101 is grasped underhanded with the thumb positioned over the trigger 103. From that position, the top of the locking member 130 is depressed, which disengages the locking member 130 from the activation member 123 due to the compression of the spring 133. In the same motion that depresses the locking member 130, the actuator 120 is moved forward until the locking member 130 resides within a rear portion of the aperture 126, thereby placing the trigger 103 in its released or fired position. The actuator 120 now moves forward because the groove 132 is aligned with the aperture 126. Moreover, the activating member 123 and the engaging member 124 travel forward due to the removed portion 128, which provides a space between the engaging member 124 and the front face of the aperture 105. The forward travel of the engaging member 124 compresses the delivery tube 117 of the canister 118 against the cavity 116 of the nozzle 102 facilitating release of incapacitating spray from the canister 118. The incapacitating spray ejects from the canister 118 and delivery tube 117 and into the passageway 115 of the nozzle 102. The passageway 115 delivers the incapacitating spray from the nozzle 102 and further serves to focus the incapacitating spray onto a target.

Upon the release of the actuator 120, the delivery tube 117 decompresses from against the cavity 116 of the nozzle 102. The delivery tube 117 thus forces the canister 118 rearward, which, in turn, moves the activating member 123 and the engaging member 124 backward. Particularly, the actuator 120 moves backward until the locking member 130 resides within the front portion of the aperture 126 so that the spring 133 biases the locking member 130 against the activating member 123, which again places the trigger 103 in its locked or unfired position. A biasing mechanism such as a spring may be inserted between the nozzle 102 and the canister 118 or the engaging member 124 and the canister 118 to aid in returning the trigger 103 to its locked or unfired position. Incapacitating spray is thusly ejected from the baton 100 until the canister 118 is empty, at which point, the canister 118 is removed and substituted with a filled one.

The baton 100 provides many advantages as a tool for self-defense. Illustratively, the baton 100 is versatile in that it allows the securing of various attachments thereto, such as a flashlight or any suitable device including but not limited to a taser, stun gun, night stick, key chain, and the like. Further, the location of the trigger 103 permits advantageous grasping of the baton 100 for self-defense situations. The baton 100 is grasped underhanded with the thumb positioned directly over the trigger 103. From that position, the lock 121 may be released and the trigger 103 actuated in one simple motion as described above, which is extremely advantageous in self-defense situations. The underhanded grasping of the baton 100 also permits the activation of the trigger 103 to facilitate ejection of incapacitating spray with the baton 100 held extended at full arms length, which prevents incapacitating spray from accidentally landing on the face of the user. Moreover, the underhanded grasping of the baton 100 permits the ejection of incapacitating spray at an upward angle, which is a most effective angle for ensuring the incapacitating spray lands on the face of an assailant and enters the eyes, nose, and throat of the assailant. Still further, the baton 100 functions as an effective blunt instrument for thrusting into the body of an assailant, thereby rendering the assailant incapacitated.

Additionally, the nozzle 102 includes protrusions 112 that facilitate the emptying of a pocket without the necessity of using one's hand, which is advantageous for law enforcement officers, as suspects often have a needle, knife, razor blade, or other sharp instruments in their pockets. Particularly, the baton 100 is thrust into a pocket so that the protrusions 112 grasp the pocket. The baton 100 is then removed which reverses the pocket and empties its contents.

Figures 7, 8A, 8B:
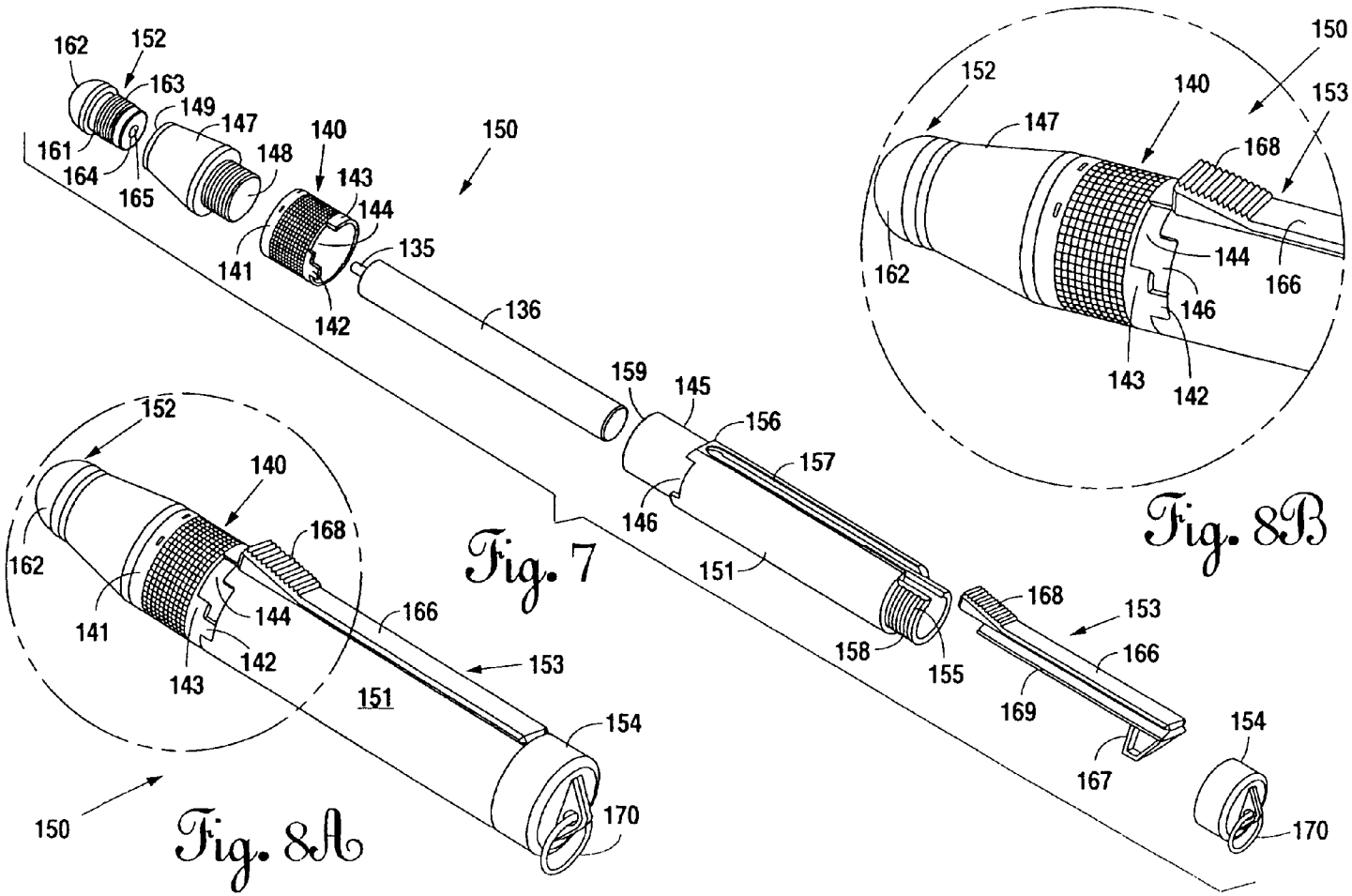
FIG. 7 is an exploded perspective view illustrating a fourth embodiment of a baton including an incapacitating spray canister for insertion therein.
FIG. 8A is a perspective view illustrating the baton according to the fourth embodiment.
FIG. 8B is a perspective view illustrating front portion of the baton according to the fourth embodiment.

As illustrated in FIGS. 7, 8A, and 8B, a baton 150 according to a fourth embodiment is suitable for use in self-defense and includes a body 151, a nozzle 152, a trigger 153, an end cap 154, and a lock 140. The body 151 includes a bore 155 therethrough, a base 156 that receives the trigger 153 thereon, and an aperture 157 that communicates with the bore 155 and receives the trigger 153 therein. The underneath edge of the base 156 may include a beveled surface that provides for easier engagement of the trigger 153 with the base 156. The body 151 further includes a surface 145 and a notch 146 that receive the lock 140 and a cap 147 that maintains the lock attached to the body 151.

The rear end 158 of the body 151 is adapted to receive the cap 154. In this fourth embodiment, the rear end 158 and the cap 54 include threads that engage to secure the cap 54 onto the baton 150. Alternatively, the cap 54 may be press fit onto the rear end 58. The cap 54 is adapted to receive an attachment, such as the illustrated key ring 170 or any suitable device including but not limited to a taser, stun gun, night stick, flashlight, and the like.

The bore 155 at a front portion 159 is adapted to receive the cap 147 therein. Particularly, in this fourth embodiment, the front portion 159 of the bore 155 and the cap 147 include threads that engage to secure the cap 147 to the front portion 159. The cap 147 includes a bore 148 therethrough and a front portion 149 adapted to receive the nozzle 152 therein. Particularly, in this fourth embodiment, the front portion 149 of the cap 147 includes threads that receive the nozzle 152 therein to secure the nozzle 152 to the body 151.

The nozzle 152 includes a body 161 terminating in a tip 162. The tip 162 may include knurls or protrusions. The body 161 is adapted to fit within the front portion 149 of the cap 147, and the tip 162 abuts the front edge of the cap 147. In this fourth embodiment, the body 161 of the nozzle 152 includes threads 163 that engage the threads of the cap 147 to facilitate securing of the nozzle 152 to the body 151. The nozzle 152 includes a passageway 164 therethrough that facilitates the delivery of an incapacitating spray through the nozzle 152. Further, the nozzle 152 includes a cavity 165 in communication with the passageway 164. The cavity 165 receives therein a delivery tube 135 of an incapacitating spray canister 136 to align the canister 136 with the nozzle 152 and facilitate the release of incapacitating spray into the passageway 164.

The trigger 153 is movable between an unfired position and a fired position. The trigger 153 includes an actuator member 166 and an engaging member 167. The actuator member 166 includes a ramped surface 168 and a securing surface 169 that engages the underneath edge of the base 156 to maintain the trigger 153 on the base 156. The securing surface 169 of the actuator member 166 may include a beveled surface that provides for easier engagement of the trigger 153 with the base 156. The securing surface 169 aligns with the aperture 157 and the trigger 153 slides forward until it resides completely within the aperture 157. The cap 154 secures to the rear end 158 of the body 151 in a position where the front edge of the cap 154 abuts the rear edge of the trigger 153 to maintain the trigger 153 within the aperture 157. The engaging member 167 resides within the bore 155 and blocks the bore 155 to define a chamber that receives the canister 136 of incapacitating spray therein.

The lock 140 is movable between a safe position and a fire position and, in this fourth embodiment, comprises a sleeve 141 that fits over the surface 145 of the body 151. The lock 140 includes a tab 142 that protrudes from the sleeve 141 into the notch 146 of the body 151 when the lock 140 resides over the surface 145. The lock 140 further includes at one end of the sleeve 141 a lip 143 having a notch 144 therein. The lock 140 slides over the surface 145 of the body 151 until the tab 142 fits within the notch 146 of the body 151. After placing the lock 140 over the surface 145, the cap 147 secures to the front portion 159 of the bore 155 in a position where the rear edge of the cap 147 abuts the front edge of the lock 140 to maintain the lock 140 mounted on the body 151. In its safe position as illustrated in FIGS. 8A and 8B, the lock 140 is pivoted such that the tab 142 resides in a lower portion of the notch 146 of the body 151. With the tab 142 located in a lower portion of the notch 146, the lip 143 engages the front portion of the trigger 153, thereby blocking the trigger 153 and thus preventing forward motion of the trigger 153 from its unfired position to its fired position. Movement of the lock 140 from its safe position to its fire position occurs through pivoting the lock 140 such that the tab 142 resides in an upper portion of the notch 146 of the body 151. With the tab 142 located in an upper portion of the notch 146, the notch 144 in the lip 143 resides at the front portion of the trigger 153, thereby providing a space that permits forward motion of the trigger 153 from its unfired position to its fired position.

In use, the nozzle 152 is removed from the cap 147 of the body 151 and the canister 136 of incapacitating spray is slid into the chamber defined by the bore 115 and the engaging member 167 until its rear end abuts the front face of the engaging member 167. The nozzle 152 is then replaced such that the delivery tube 135 of the canister 136 resides within the cavity 165 of the nozzle 152. To fire incapacitating spray from the canister 136, the body 151 is grasped underhanded with the thumb positioned over the trigger 153, and the lock 142 is moved from its safe position to its fire position. From that position, the thumb moves the actuator member 166 forward, which places the trigger 153 in its fired position as the trigger 153 travels forward into the notch 144 of the lip 143. Particularly, the actuator member 166 and the engaging member 167 travel forward due to the aperture 157 being longer than the trigger 153. The forward travel of the engaging member 167 compresses the delivery tube 135 of the canister 136 against the cavity 165 of the nozzle 152 facilitating release of incapacitating spray from the canister 136. The incapacitating spray ejects from the canister 136 and delivery tube 135 and into the passageway 164 of the nozzle 152. The passageway 164 delivers the incapacitating spray from the nozzle 152 and further serves to focus the incapacitating spray onto a target.

Upon the release of the actuator member 166, the delivery tube 135 decompresses from against the cavity 165 of the nozzle 152. The delivery tube 135 thus forces the canister 136 rearward, which, in turn, moves the actuator member 166 and the engaging member 167 backward, thereby returning the trigger 153 to its unfired position. After the return of the trigger 153 to its unfired position, the lock 142 may be moved from its fire position to its safe position to prevent the accidental discharge of incapacitating spray. A biasing mechanism such as a spring may be inserted between the nozzle 152 and the canister 136 or the engaging member 167 and the canister 136 to aid in returning the trigger 153 to its unfired position. Incapacitating spray is thusly ejected from the baton 150 until the canister 136 is empty, at which point, the canister 136 is removed and substituted with a filled one.

The baton 150 provides many advantages as a tool for self-defense. Illustratively, the location of the trigger 153 permits advantageous grasping of the baton 150 for self-defense situations. The baton 150 is grasped underhanded with the thumb positioned directly over the trigger 153. From that position, the trigger 153 may be actuated in one simple motion as described above, which is extremely advantageous in self-defense situations. The underhanded grasping of the baton 150 further permits the actuation of the trigger 153 to facilitate ejection of incapacitating spray with the baton 150 held extended at full arms length, which prevents incapacitating spray from accidentally landing on the face of the user. Moreover, the underhanded grasping of the baton 150 permits the ejection of incapacitating spray at an upward angle, which is a most effective angle for ensuring the incapacitating spray lands on the face of an assailant and enters the eyes, nose, and throat of the assailant. Still further, the baton 150 functions as an effective blunt instrument for thrusting into the body of an assailant, thereby rendering the assailant incapacitated.

Figure 9:
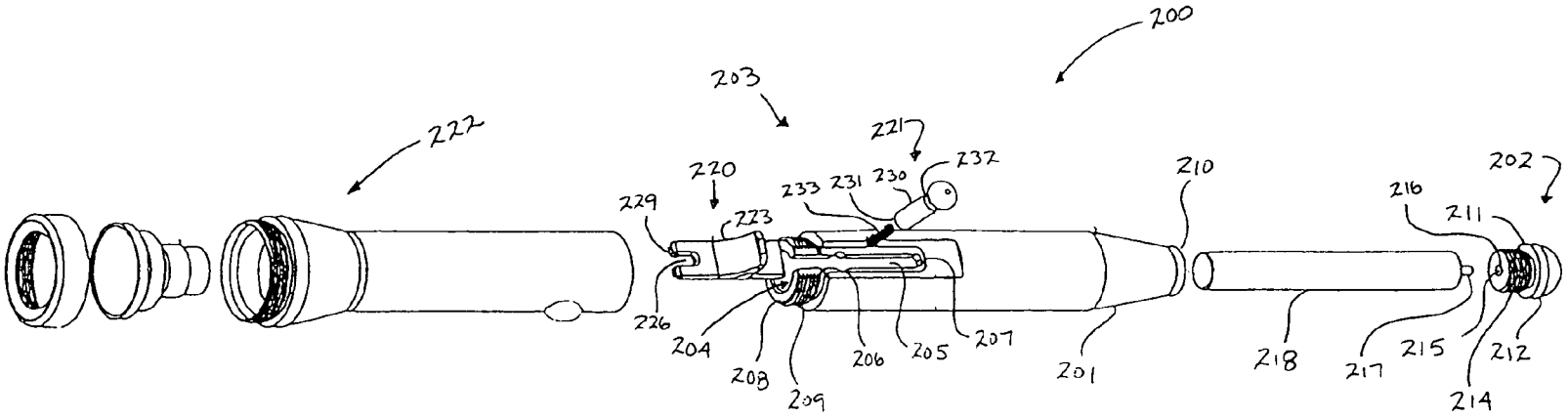
FIG. 9 is an exploded perspective view illustrating a fifth embodiment of a baton including an incapacitating spray canister for insertion therein and a flashlight as an attachment.
Figure 10:
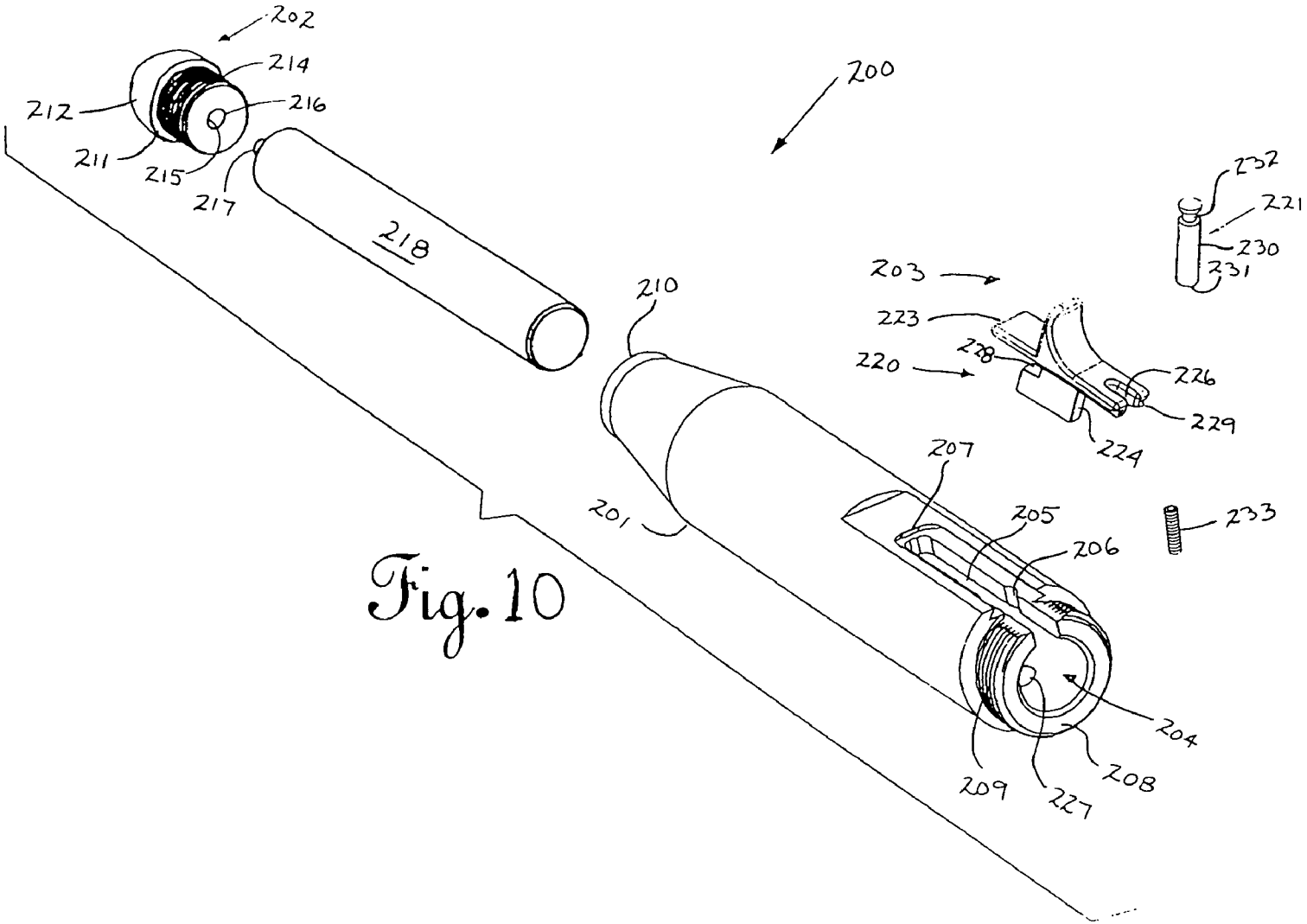
FIG. 10 is an exploded perspective view illustrating the baton according to the fifth embodiment.
Figure 11:
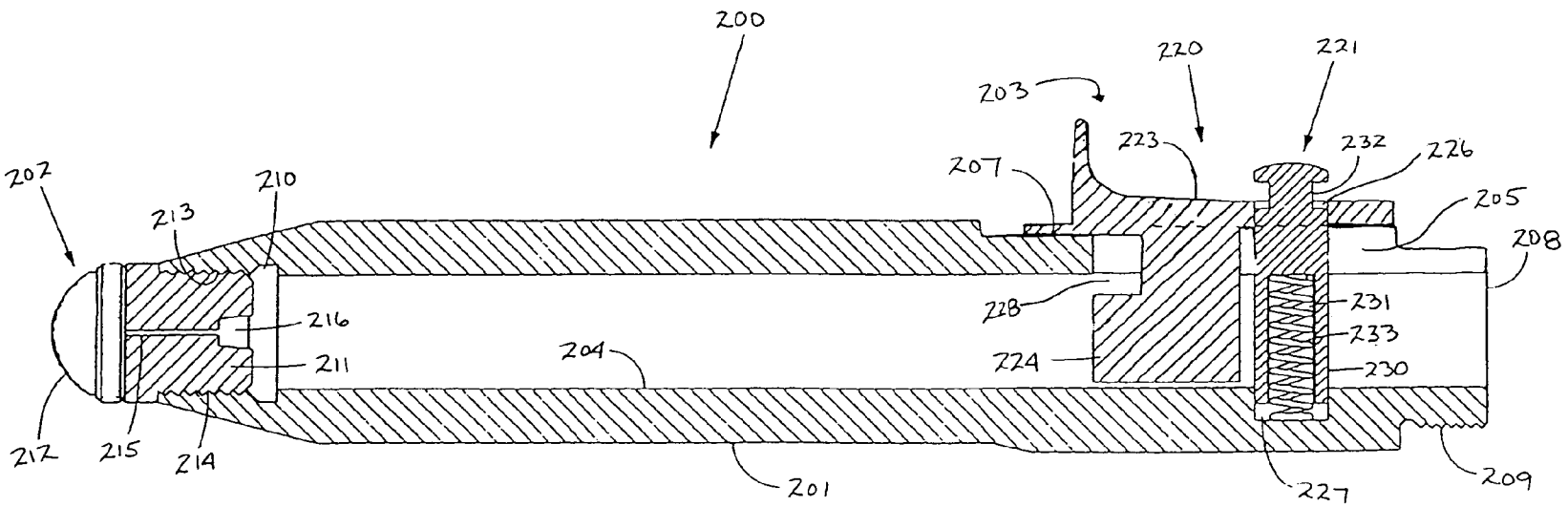
FIG. 11 is a side elevation view in cross-section illustrating the baton according to the fifth embodiment.

As illustrated in FIGS. 9–11, a baton 200 according to a fifth embodiment is suitable for use in self-defense and includes a body 201, a nozzle 202, and a trigger 203. The body 201 includes a bore 204 therethrough, a base 207 that receives the trigger 203 thereon, and an aperture 205, including a cavity 206, that communicates with the bore 204 and receives the trigger 203 therein. The rear end 208 of the body 201 is adapted to receive an attachment, such as a flashlight 222 or any suitable device including but not limited to a taser, stun gun, night stick, key chain, and the like. In this fifth embodiment, the rear end 208 includes threads 209 that receive the attachment thereon to secure the attachment to the baton 200. The bore 204 at a front portion 210 is adapted to receive the nozzle 202 therein. Particularly, in this fifth embodiment, the front portion 210 of the bore 204 includes threads 213 that receive the nozzle 202 therein to secure the nozzle 202 to the body 201.

The nozzle 202 includes a body 211 terminating in a tip 212 that, in this fifth embodiment includes a smooth surface. The body 211 is adapted to fit within the front portion 210 of the bore 204, and the tip 212 abuts the front edge of the body 201. In this fifth embodiment, the body 211 of the nozzle 202 includes threads 214 that engage the threads 213 in the front portion 210 of the bore 204 to facilitate the securing of the nozzle 202 to the body 201. The nozzle 202 includes a passageway 215 therethrough that facilitates the delivery of an incapacitating spray through the nozzle 202. Further, the nozzle 202 includes a cavity 216 in communication with the passageway 215. The cavity 216 receives therein a delivery tube 217 of an incapacitating spray canister 218 to align the canister 218 with the nozzle 202 and facilitate the release of incapacitating spray into the passageway 215.

The trigger 203 is movable between a locked or unfired position and a released or fired position and includes an actuator 220 and a lock 221. The actuator 220 includes an activation member 223 having a ramped surface and including an aperture 226 and a securing surface 229. The actuator 220 further includes an engaging member 224 having a removed portion 228. In this fifth embodiment, the activation member 223 and the engaging member 224 are formed as one integral piece. The lock 221 includes a locking member 230, having a cavity 231 therein and a groove 232 thereabout. The lock 221 further includes a biasing mechanism, which in this fifth embodiment is a spring 233, although any suitable biasing mechanism may be used.

The actuator 220 slides into the aperture 205 such that the activation member 223 mounts on the base 207 and the securing surface 229 engages an underneath edge of the base 207 to maintain the trigger 203 on the base 207. Further, the engaging member 224 resides within the bore 204 to block the bore 204 and define a chamber that receives the canister 218 therein. The base 207 and the removed portion 228 of the engaging member 224 permit the actuator 220 to slide forward to a position that exposes the cavity 206 of the aperture 205. The spring 233 fits within the cavity 231, and the locking member 230 and the spring 233 pass through the cavity 206 and reside within the bore 204 of the body 201. The body 201 at the portion of bore 204 below the locking member 230 and the spring 233 may include a cavity 227 that receives the spring 233 and the locking member 230 therein to secure the lock 221 within the bore 204. After the mounting of the lock 221, the groove 232 is aligned with the aperture 226 of the activation member 223, and the actuator 220 is slid rearward until the locking member 230 resides within a front portion of the aperture 226. An underneath edge of the aperture 226 engages the lower surface of the locking member 230 defining the groove 232 to maintain the locking member 230 within and abutting against the activation member 223. Consequently, in this fifth embodiment, the lock 221 assists in maintaining the actuator 220 mounted on the body 201 by preventing the actuator 220 from sliding rearward and out from the aperture 205.

The trigger 203 begins in the locked or unfired position because the spring 233 biases the locking member 230 against the activation member 223. In use, the nozzle 202 is removed from the body 201 and the canister 218 is slid into the chamber defined by the bore 204 and the engaging member 224 until its rear end abuts the front face of the engaging member 224. The nozzle 202 is then replaced such that the delivery tube 217 of the canister 218 resides within the cavity 216 of the nozzle 202. To fire incapacitating spray from the canister 218, the body 201 is grasped underhanded with the thumb positioned over the trigger 203. From that position, the top of the locking member 230 is depressed, which disengages the locking member 230 from the activation member 223 due to the compression of the spring 233. In the same motion that depresses the locking member 230, the actuator 220 is moved forward until the locking member 230 resides within a rear portion of the aperture 226, thereby placing the trigger 203 in its released or fired position. The actuator 220 now moves forward because the groove 232 is aligned with the aperture 226. Moreover, the activating member 223 and the engaging member 224 travel forward due to the removed portion 228, which provides a space between the engaging member 224 and the front face of the aperture 205. The forward travel of the engaging member 224 compresses the delivery tube 217 of the canister 218 against the cavity 216 of the nozzle 202 facilitating release of incapacitating spray from the canister 218. The incapacitating spray ejects from the canister 218 and delivery tube 217 and into the passageway 215 of the nozzle 202. The passageway 215 delivers the incapacitating spray from the nozzle 202 and further serves to focus the incapacitating spray onto a target.

Upon the release of the actuator 220, the delivery tube 217 decompresses from against the cavity 216 of the nozzle 202. The delivery tube 217 thus forces the canister 218 rearward, which, in turn, moves the activating member 223 and the engaging member 224 backward. Particularly, the actuator 220 moves backward until the locking member 230 resides within the front portion of the aperture 226 so that the spring 233 biases the locking member 230 against the activating member 223, which again places the trigger 203 in its locked or unfired position. A biasing mechanism such as a spring may be inserted between the nozzle 202 and the canister 218 or the engaging member 224 and the canister 218 to aid in returning the trigger 203 to its locked or unfired position. Incapacitating spray is thusly ejected from the baton 200 until the canister 218 is empty, at which point, the canister 218 is removed and substituted with a filled one.

The baton 200 provides many advantages as a tool for self-defense. Illustratively, the baton 200 is versatile in that it allows the securing of various attachments thereto, such as the flashlight 222 or any suitable device including but not limited to a taser, stun gun, night stick, key chain, and the like. Further, the location of the trigger 203 permits advantageous grasping of the baton 200 for self-defense situations. The baton 200 is grasped underhanded with the thumb positioned directly over the trigger 203. From that position, the lock 221 may be released and the trigger 203 actuated in one simple motion as described above, which is extremely advantageous in self-defense situations. The underhanded grasping of the baton 200 also permits the activation of the trigger 203 to facilitate ejection of incapacitating spray with the baton 200 held extended at full arms length, which prevents incapacitating spray from accidentally landing on the face of the user. Moreover, the underhanded grasping of the baton 200 permits the ejection of incapacitating spray at an upward angle, which is a most effective angle for ensuring the incapacitating spray lands on the face of an assailant and enters the eyes, nose, and throat of the assailant. Still further, the baton 200 functions as an effective blunt instrument for thrusting into the body of an assailant, thereby rendering the assailant incapacitated.

Additionally, the nozzle 202 may be magnetized to facilitate the emptying of a pocket without the necessity of using one's hand, which is advantageous for law enforcement officers, as suspects often have a needle, knife, razor blade, or other sharp instruments in their pockets. Particularly, the baton 200 is thrust into a pocket so that the magnetized nozzle 202 engages any instruments within the pocket. The baton 200 is then removed to withdraw any instruments within the pocket.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

We claim:

1. A baton, comprising:

a body adapted to receive a canister of spray therein, the body including an aperture;

a nozzle securable to the body and adapted to receive spray therethrough; and a trigger mounted on the body, the trigger comprising:

an actuator mounted on the body and extending therein via the aperture of the body, the actuator including an aperture, and a lock disposed in the aperture of the actuator and engaged with the actuator, whereby releasing the lock from the actuator permits movement of the actuator from an unfired position to a fired position that facilitates ejection of spray from the canister through the nozzle.

2. The baton according to claim 1, wherein the trigger mounts on the body in a location that permits grasping of the body with the thumb positioned over the trigger to permit release of the lock and movement of the actuator from the unfired position to the fired position.

3. The baton according to claim 1, wherein the actuator, comprises:

an engaging member disposed through the aperture of the body; and an activation member mounted on the body and coupled with the engaging member.

4. The baton according to claim 1, wherein the trigger further comprises a pin that engages the actuator to secure the actuator on the body.

5. The baton according to claim 4, wherein the actuator includes a slot that receives the pin therein.

6. The baton according to claim 1, wherein the lock comprises:

a locking member disposed through the aperture of the body; and a biasing mechanism that biases the locking member against the actuator.

7. The baton according to claim 1, wherein the nozzle includes a passageway therethrough.

8. The baton according to claim 7, wherein the nozzle includes a cavity communicating with the passageway, whereby the cavity receives a delivery tube of the canister of spray therein.

9. The baton according to claim 1, wherein the nozzle includes knurls or protrusions on its outer surface.

10. The baton according to claim 1, wherein the actuator includes a securing surface that engages the body to maintain the trigger mounted to the body.

11. The baton according to claim 1, wherein the rear end of the body is adapted to receive attachments thereon.

12. A baton, comprising:

a body adapted to receive a canister of spray therein, the body including an aperture;

a nozzle securable to the body and adapted to receive spray therethrough;

a trigger mounted on the body in a location that permits grasping of the body underhanded with the thumb positioned over the trigger to permit movement of the trigger from an unfired position to a fired position that facilitates ejection of spray from the canister through the nozzle; and a cap secured to a rear end of the body to maintain the trigger in the aperture of the body.

13. The baton according to claim 12, wherein the trigger engages the aperture of the body.

14. The baton according to claim 12, wherein the trigger includes a securing surface that engages the body to maintain the trigger mounted to the body.

15. The baton according to claim 12, wherein the cap is adapted to receive attachments thereon.

16. The baton according to claim 12, further comprising a lock movable from a safe position that blocks the trigger to a fire position that unblocks the trigger.

17. The baton according to claim 16, wherein the lock mounts on the body and includes:

a lip having a notch therein; and a tab that protrudes into a notch in the body, whereby movement of the tab to a first position within the notch of the body locates the lip in the front portion of the trigger thereby blocking the trigger and movement of the tab to a second position within the notch of the body locates the notch of the lip in the front portion of the trigger thereby unblocking the trigger.

18. The baton according to claim 12, wherein the actuator, comprises:

an engaging member disposed through the aperture of the body; and an activation member mounted on the body and coupled with the engaging member.

19. The baton according to claim 12, wherein the nozzle includes a passageway therethrough.

20. The baton according to claim 19, wherein the nozzle includes a cavity communicating with the passageway, whereby the cavity receives a delivery tube of the canister of spray therein.

21. The baton according to claim 12, wherein the nozzle includes knurls or protrusions on its outer surface.

* * * * *